United States Patent [19]

Bannister et al.

[11] Patent Number: 4,910,392

[45] Date of Patent: Mar. 20, 1990

[54] COUNTER MECHANISMS

[75] Inventors: Ray L. Bannister, Richmond; Frederick C. Close, Great Amwell; Peter J. Loeber, Earith, all of United Kingdom

[73] Assignee: Pitney Bowes plc, Harlow, United Kingdom

[21] Appl. No.: 28,432

[22] Filed: Mar. 20, 1987

[51] Int. Cl.[4] ..... G06C 15/42; G06C 25/00

[52] U.S. Cl. ..... 235/101; 235/1 C; 235/117 A; 235/139 A; 235/144 PN

[58] Field of Search ..... 235/1 C, 101, 108–110, 235/113, 136, 131 JA, 131 M, 139 A, 144 S, 144 SM, 144 SS, 144 EA, 144 HC, 144 PN, 91 R, 114, 117 A, 132 R, 139 R

[56] References Cited

U.S. PATENT DOCUMENTS

| | | | |
|---|---|---|---|
| 381,561 | 4/1888 | Lamb | 235/117 A |
| 1,566,628 | 12/1925 | Stosick | 235/144 EA |
| 1,742,567 | 1/1930 | West | 235/117 A |
| 2,444,570 | 7/1948 | Lawrence et al. | 235/144 S |
| 2,510,350 | 6/1950 | Rouan et al. | 101/91 |
| 2,516,920 | 8/1950 | Royan et al. | 235/101 X |
| 2,774,537 | 12/1956 | Russell et al. | 235/139 R |
| 2,996,241 | 8/1961 | Hoffmann | 235/1 C |
| 3,302,876 | 2/1967 | Fox | 235/139 R X |
| 3,469,777 | 9/1969 | Anderson et al. | 235/101 |
| 3,885,136 | 5/1975 | Erickson | 235/132 R X |
| 3,889,085 | 6/1975 | Lockard | 235/117 A X |
| 4,007,359 | 2/1977 | Ford | 235/101 |
| 4,015,109 | 3/1977 | Deming | 235/144 PN X |

*Primary Examiner*—B. R. Fuller

*Attorney, Agent, or Firm*—Michael J. DeSha; David E. Pitchenik; Melvin J. Scolnick

[57] ABSTRACT

A counter mechanism for a postage meter includes a number of sections each having a number wheel (14) repesenting the respective order of accounted value, transfer mechanisms in the form of Geneva gears connecting the number wheels (14) to provide carry-over movements between adjacent sections. A ratchet mechanism is provided in the number wheel (14) to allow rotation of the number drum (16) as a result of an account input from the postage meter, even when a carry movement gear (18) of the number wheel (14) is locked by the Geneva gear. The ratchet mechanism includes an internally-profiled surface on one part (16) having ratchet steps (70) separated by portions (76) of relatively low gradient. Projections (74) are provided on a central member (72) of another part (18), the projections extending substantially tangential to the internally-profiled surface so as to engage in the ratchet steps (70) in the event of attempted rotation in one direction and to stop such rotation. Rotation in the other direction can take place.

The counter mechanism may also include thumbwheels for resetting the lower order number wheels (14), the thumbwheels including similar ratchet mechanisms.

7 Claims, 3 Drawing Sheets

COUNTER MECHANISMS

FIELD OF THE INVENTION

This invention relates to counter mechanisms, and in particular to such mechanisms in postage meters.

BACKGROUND OF THE INVENTION AND PRIOR ART

Counter mechanisms are known in which an input typically drives a lowest order number wheel and, where the number being counted is to be expressed in the decimal system, the lowest order number wheel transfers a "carry-over" movement to the next order number wheel when the number nine changes to zero. Similar transfer movements are provided for the number of wheels of the other orders. So-called Geneva mechanisms can be used to provide the required operation.

In postage meters, counter mechanisms are required to maintain an account of certain quantities, such as the total value of postage printed, the value of postage credit remaining, and the like. However, since the postage value can involve several orders, the counter mechanism must be capable of accepting count inputs to several of its lower order number wheels, as well as including the facility to carry over a single digit movement to the next order number wheel when the number nine is exceeded. One such mechanism is disclosed in U.S. Pat. No. 2,774,537 (Russell et al), in which differentially geared number wheels including a planet and sun gear arrangement provide the facility to accept a direct mechanical count input as well as a carry-over transfer input from the next lower order wheel. The gear arrangement is relatively complex and difficult to assemble.

Other designs of counting or registering mechanisms are shown in British Patent Specification No. 735 443 published in 1955, U.S. Pat. No. 4,015,109 (Deming) published 1977 and British Application Serial No. 2 024 478 published in 1980. U.S. Pat. No. 2,510,350 (Rouan and Knauer) shows a registering mechanism connected to a value setting mechanism in a postage meter.

In counter mechanisms in postage meters, the possibility must be provided for resetting the mechanism, when extra credit is purchased from the appropriate authority. The resetting means must be arranged to be secure so as to prevent fraudulent resetting. Typically, the resetting means includes a rotatable shaft with an operating knob behind a normally locked and/or sealed door in the housing. Rotation of the shaft typically causes only the higher three orders to be reset, the shaft itself acting on the lowermost of the three and the other two being stepped on by their carry transfer mechanisms. Thus it is only possible to purchase postal credit in comparatively large increments, there typically being another four non-resettable lower order wheels provided in such a mechanism. If the mechanism was modified to extend the resetting means to act on the lower order number wheels as well, in order to make credit purchase more flexible, the resetting shaft would then need to be rotated a very considerable number of times to reset the higher order numbers, which would be impractical.

SUMMARY OF THE INVENTION

According to the present invention, there is provided a counter mechanism for a postage meter, the counter mechanism comprising a plurality of number wheels representing different number orders of accounted value and having transfer mechanisms for providing a carry movement to the next higher order, and a resetting means including a shaft rotation which is arranged to reset only a selected number of the higher order number wheels, characterised in that the resetting means comprises resetting wheels each of which is operable to engage one of the number wheels not affected by rotation of the resetting shaft, rotation of each resetting wheel acting to reset the number wheel associated therewith, each resetting wheel including a ratchet mechanism for allowing resetting of the number wheel in only one direction.

The resetting wheels are preferably thumbwheels positioned under a secure sealed and/or locked cover in similar manner to that described above with reference to the rotatable shaft resetting mechanism. The ratchet mechanism in each wheel is preferably similar to that previously described with reference to the number wheel ratchet mechanism. The thumbwheel is conveniently provided with a coaxial gear portion which can act either directly or via further gearing on a gear portion associated with the number wheel.

Thus, for example, the highest three orders can be reset using the conventional resetting shaft mechanism, rotation acting directly on the lowest of the three orders and indirectly on the others via the carry transfer mechanisms. Resetting of the remaining orders can be achieved by rotation of the appropriate thumbwheels.

According to an aspect of the invention, there is provided a counter mechanism for a postage meter, the counter mechanism comprising a plurality of number wheels representing different number orders of accounted value and having transfer mechanisms for providing a carry movement to the next higher order, characterised in that each number wheel includes a ratchet mechanism a first part of which has a generally cylindrical internally-profiled surface having a plurality of ratchet steps corresponding to stop positions of the ratchet mechanism, the steps being separated by low gradient portions, a second part of the ratchet mechanism comprising a rotatable central member with at least one resilient projection projecting in a direction substantially tangential to the internally-profiled surface of the first part, the resilient projection being biased radially outwardly so as to engage one of the ratchet steps and to prevent rotation in one direction while allowing rotation in the other direction by resiliently yielding over the low gradient portions of the internally-profiled surface. In such an arrangement, two resilient projections are provided on opposite sides of the rotatable central member and the internally-profiled surface has ten steps, one corresponding to each number of the ten which can be registered by the number wheel. The steps are arranged along a part of the corresponding radius and the low gradient portions connect the top of one step to the bottom of the adjacent step, preferably in a straight line. The resilient projections have their contact surfaces at a very slight angle with respect to the low gradient portions such that when in contact, the surfaces are almost parallel, particularly near the top of each step. This has the effect of minimising resilient movement of the projections and thereby reducing wear on the contact surfaces. Also, this particular form of mechanism provides a certain amount of positive return action, in that if the number wheel is positioned with the projections contacting part way along the low gradient portions, the resilience of the projections will cause relative rotation until the ends of the projections abut the steps at the end of the particular low gradient portions. With this arrangement, the number wheels will tend to align at particular numbers, instead of at intermediate positions. This provides for a clear and unambiguous display, which has not always been the case with previously-known mechanisms.

BRIEF DESCRIPTION OF THE DRAWINGS

The invention will now be described, by way of illustrative and nonlimiting example, with reference to the accompanying drawings, in which:-

DETAILED DESCRIPTION OF A PREFERRED EMBODIMENT

Figure 1:
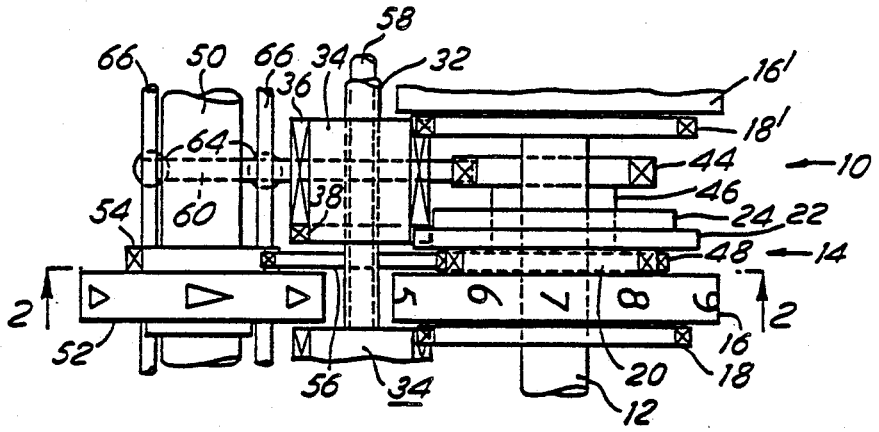
FIG. 1 is a plan view of one type of section of a counter mechanism embodying the invention.
Figure 2:
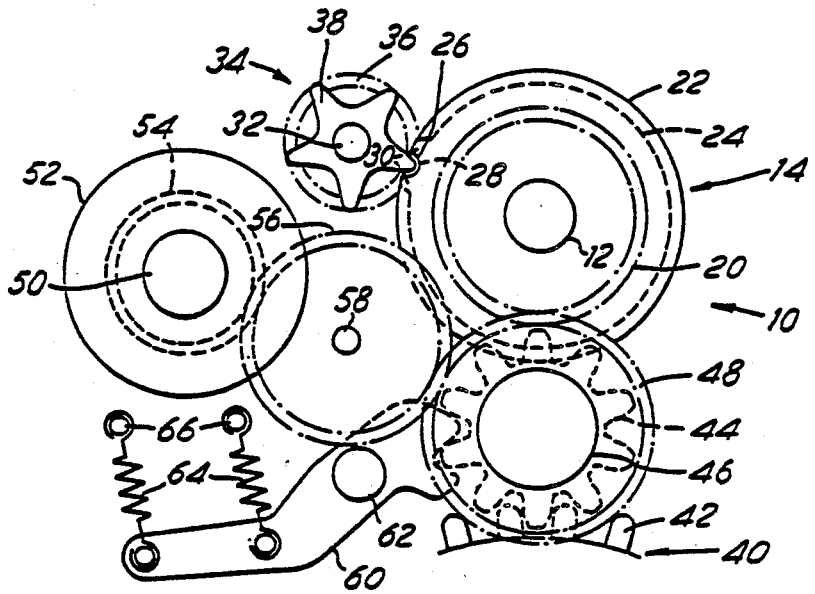
FIG. 2 is a sectional view on the line 2—2 in FIG. 1.
Figure 3:
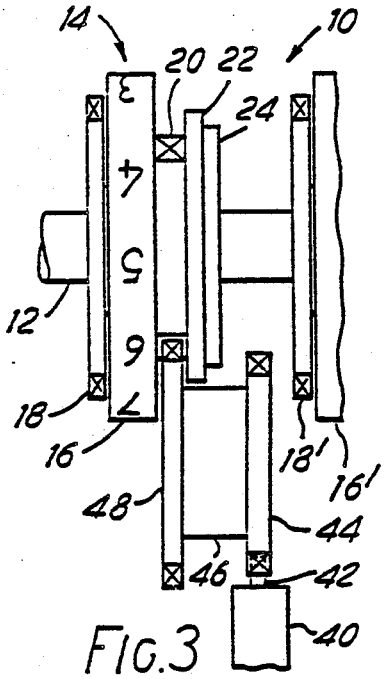
FIG. 3 is a partial view of the mechanism shown in FIGS. 1 and 2, as seen from the right hand side of FIGS. 1 and 2.

Referring initially to FIGS. 1, 2 and 3, there is shown a first type of counter mechanism section 10 which is suitable for a lower number order of a counter of a postage meter, which section is to be directly incremented by an accounting mechanism of the postage meter, and which is connected to the next higher and the next lower order sections for performing respective carry operations; the section 10 is also directly resettable when extra value is entered into the postage meter, as will be described below. In other words, this section 10 will correspond to a number order of value which can be set on the postage meter for an individual franking operation, typically this would be the lowest four orders of the counter. Reference is directed to the aforementioned U.S. Pat. No. 2,774,537 for a description of the complete assembly of a counter mechanism in a postage meter.

The section 10 includes a number wheel shaft 12 which, as will be described later with reference to FIG. 6, passes through all sections of the counter mechanism. The number wheel shaft 12 in the section 10 carries a number wheel assembly 14 for rotation with respect to the shaft 12. The assembly 14 includes a number drum 16 and a carry movement gear 18 which are connected by a ratchet mechanism (to be described with reference to FIGS. 4 and 5) allowing relative rotation between the number drum 16 and the carry movement gear 18 in one direction only. Integral with or fixed to the number drum 16 are respectively a number wheel gear 20, a first disc 22 and a second disc 24. The first disc 22 has a larger diameter than the second disc 24. As will be seen in FIG. 2, each of the first and second discs 22, 24 includes an opening 26, 28 respectively at aligned positions along the periphery. In addition, the second disc 24 includes two projections 30 on each side of the opening 28 extending at least substantially to the periphery of the first disc 22.

A Geneva shaft 32 extends through the counter mechanism parallel to the number wheel shaft 12. The Geneva shaft 32 carries a Geneva gear 34 arranged to transfer movement from the discs 22, 24 to a carry movement gear 18' of the next higher order section, the carry movement gear 18' being connected to a number drum 16' by a ratchet mechanism in similar manner to that previously described. For this purpose, the Geneva gear 34 includes a Geneva pinion 36 having a full complement of gear teeth and engaging the next section carry movement gear 18', as well as a Geneva lock element 38 which includes a reduced number of lobes arranged to engage the opening 26 in the first disc 22 for carry transfer movement. At other times, the lock element 38 is locked by virtue of two adjoining lobes resting against the periphery of the first disc 22.

As will be seen from FIG. 1, a next lower order Geneva gear 34 engages the carry movement gear 18 of the section 10, and this provides carry transfer movement from the next lower order section. Of course, the lowest order section will not have such a feature and in that case there will be no lower order Geneva gear 34 engaging the carry movement gear 18. In fact the gear 18 may be omitted, but for the sake of manufacturing uniformity, the gear 18 will generally be provided even on the lowest order section.

Referring in particular to FIGS. 2 and 3, a direct count input from the accounting mechanism of the postage meter is provided by appropriate means, such as a rising tooth mechanism 40 in the postage meter. The number of teeth 42 projecting from the mechanism 40 is dependent on the value being franked. Further details of a rising tooth mechanism are given in U.S. Pat. No. 2,510,350. As the franking operation takes place, the mechanism 40 rotates and the projecting teeth 42 cause an accounting gear 44 to rotate. The accounting gear 44 is fixedly connected by a sleeve 46 to a further gear 48, the complete assembly being mounted on a further shaft, omitted from the drawings for the sake of clarity. The further gear 48 engages the number wheel gear 20 of the number wheel assembly 14, and accounting information is transferred by rotation of the rising tooth mechanism as rotation of the accounting gear 44 dependent on the number of projecting teeth 42, via the gear 48 and the number wheel gear 20, to the number drum 16.

The parts of the mechanism thus far described, in particular the Geneva transfer mechanism, operate in a generally similar manner to that described in the aforementioned U.S. Pat. No. 2,774,537 and reference is directed for a detailed description of that part of the operation. In brief, rotation of the rising tooth mechanism 40 causes corresponding rotation of the number drum 16 so that the appropriate order of franked value is registered by the counter. If rotation of the number drum 16 involves a change in count through zero, the Geneva gear 34 will be moved on by a predetermined amount due to engagement with the lobes 30 and openings 26, 28 in the discs 22, 24 and this rotational movement will be transferred to the carry movement gear 18' of the next section. Since whenever a carry transfer movement is not taking place, the Geneva gear 34 is locked against rotation by virtue of adjacent lobes of the lock element 38 being retained against the periphery of the disc 22, this means that the carry movement gear 18 is also prevented from rotating. This is the reason why the one-way ratchet mechanism between the number drum 16 and the carry movement gear 18 needs to be provided, so as to allow the number drum 16 to rotate and register account values during franking, even when the carry movement gear 18 is locked by the Geneva gear 34. The ratchet mechanism will be described later with reference to FIGS. 4 and 5.

Returning to FIGS. 1 to 3, the section 10 also includes a mechanism for resetting the number drum 16. This resetting mechanism includes the thumbwheel resetting shaft 50 with a thumbwheel 52 and a thumbwheel gear 54 mounted for rotation on the shaft 50. The thumbwheel 52 and gear 54 are connected by a one-way ratchet mechanism, in similar manner to the drum 16 and gear 18 of the number wheel assembly 14. Thus rotation of the thumbwheel 52 can only be transmitted to the gear 54 in one direction. An intermediate gear 56 meshes with the thumbwheel gear 54 and with the further gear 48 fixed to the accounting gear 44. Thus rotation of the thumbwheel 52 (in one direction) will be transmitted via the gears 54, 56, 48 and 20 to the number drum 16.

Also shown in FIGS. 1 and 2 is a pawl mechanism including a pawl lever 60 pivotable about a pawl shaft and held against the accounting gear 44 by springs 64 attached to spring support shafts 66 so as to allow the accounting gear 44 to rotate in only one direction. The pawl mechanism also provides positive alignment of the number drum 16 by ensuring that the accounting gear 44 adopts a definite position.

Thus if resetting of the section 10 is required, the thumbwheel 52 is rotated in the permitted direction and this movement passes via the gear 54, 56, 48 and 20 to the number drum 16 which will therefore also rotate until the required numeral is reached. Access to the thumbwheels for each of the sections will be restricted to anyone other than the authorised resetting body by a locked and/or sealed door, or the like.

In FIG. 3, only the parts associated with the number wheel shaft 12 and the assembly including the accounting gear 44, sleeve 46 and the further gear 48 are shown, for the sake of clarity.

Figure 4:
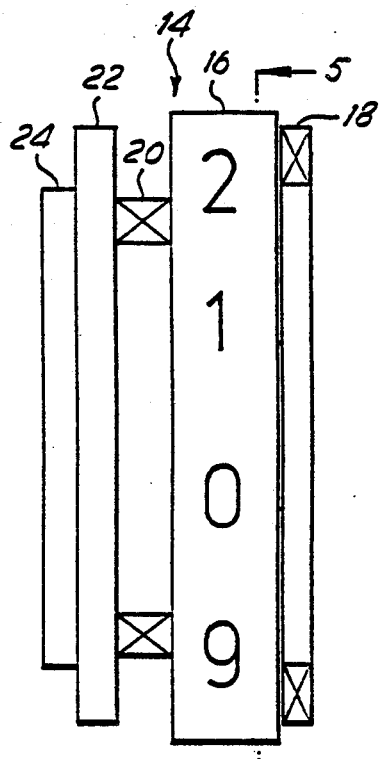
FIG. 4 is an enlarged view of the number wheel arrangement shown in FIGS. 1 to 3.
Figure 5:
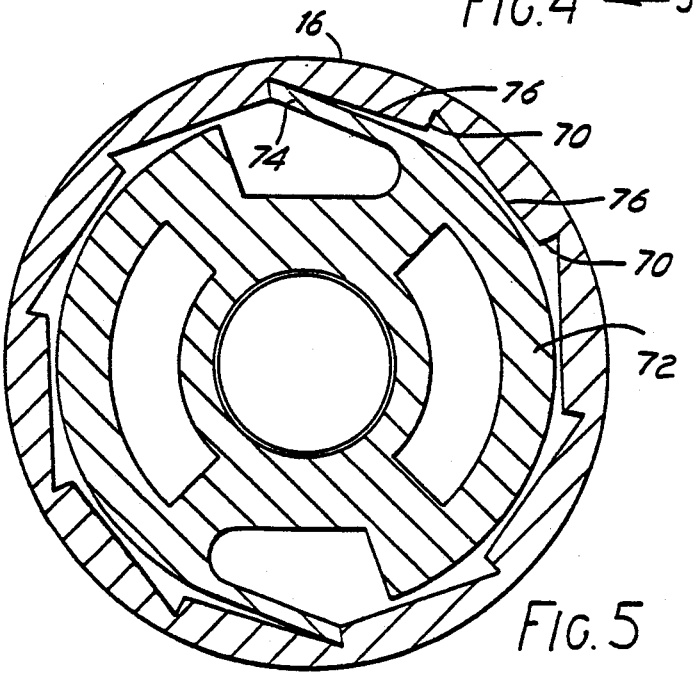
FIG. 5 is a sectional view on the line 5—5 in FIG. 4, showing the ratchet mechanism in detail.

FIGS. 4 and 5 show the number wheel assembly 14 in more detail, and in particular the one-way ratchet mechanism. FIG. 4 shows the number drum 16, the carry movement gear 18, the number wheel gear 20 and the discs 22, 24 in enlargement. Referring to FIG. 5, the details of the ratchet mechanism can be seen. The number drum 16 has an internal ratchet profile which, as shown, includes ten ratchet steps 70. It will be seen from the drawings that the number drum 16 has numerals 0 to 9 provided on its periphery, and a suitable display window will be provided in the counter mechanism to show the particular numeral corresponding to the accumulated total in that order corresponding to the particular section of the counter. The number of ratchet steps 70 will be chosen to correspond to the number of numerals on the outside of the number drum 16, so that a definite stop position is provided for each numeral, ensuring that all the number drums in the mechanism will show the total in alignment.

Inside the number drum 16, there is provided a rotatable internal ratchet part 72 which includes two resilient projections 74. The internal ratchet part 72 is fixedly attached to, preferably made integral with, the carry movement gear 18. The resilient projections 74 project from the rotatable ratchet part 72 in a direction which is substantially tangential to the internal surface of the number drum 16. The resilient projections 74 are also arranged to be biased radially outwardly. As shown, the resilient projections 74 are integral with the rotatable ratchet part 72, and in such a case, the part 72 should be made of a suitably resilient material such as plastics. The complete assembly, including the carry movement gear 18, can then be moulded as a single unit. Slope portions 76 of the internal surface of the number drum 16 between the ratchet steps 70 are designed to be slightly less angled than the resilient projections 74 when these are in compression within the number drum 16. In consequence of this, rotation of the internal ratchet part 72 will be possible in a clockwise sense relative to the number drum 16, as shown in FIG. 5. However, should rotation stop with the resilient projections 74 having their ends part-way along opposite slope portions 76, the resilience of the arrangement will tend to force the rotatable internal ratchet part 72 back in an anticlockwise sense until the resilient projections 74 come against the ratchet steps 70 which are at the bottom of the respective slope portions 76. At that point, the ratchet mechanism will be locked against further anticlockwise rotation, and there will also be a relatively weak retaining force against further rotation in a clockwise sense, thereby keeping the mechanism in registration, with the appropriate numeral aligned with the indicator window. Also, the one-way ratchet effect allows the number drum 16 to be rotated in accordance with a franking operation taking place, to account for the franked value, even though the carry movement gear 18 may be locked against rotation by the Geneva gear of the next lower order section. On the other hand, when that Geneva gear effects a carry movement rotation, the carry movement gear 18 will rotate and the number drum 16 will also rotate to change the value shown by one digit since that movement will be in the anticlockwise sense as shown in FIG. 5, and therefore the ratchet mechanism will lock the carry movement gear 18 and the number drum 16 to rotate together. Although two projections 74 have been shown, one would theoretically be sufficient; however, the balanced arrangement using two projections is more effective and hence preferred. Alternatively, more projections could be provided, although with ten steps 70 within the number drum 16, ten projections would be necessary to obtain a symmetrical arrangement.

The thumbwheel ratchet mechanism is preferably similar to that shown in FIG. 5. The internally-profiled surface is provided within the thumbwheel 52 and the internal ratchet part 72 is attached to the thumbwheel gear 54.

Although the counter mechanism has been described as deriving its count input from a rising tooth mechanism, any other conventional accounting mechanism could be used instead, as long as it includes mechanical projections which can be counted, and as long as count inputs are applied in serial form (i.e. sequentially per order) so that a number wheel assembly 14 does not receive simultaneous count inputs and carry transfer movements.

Figure 6:
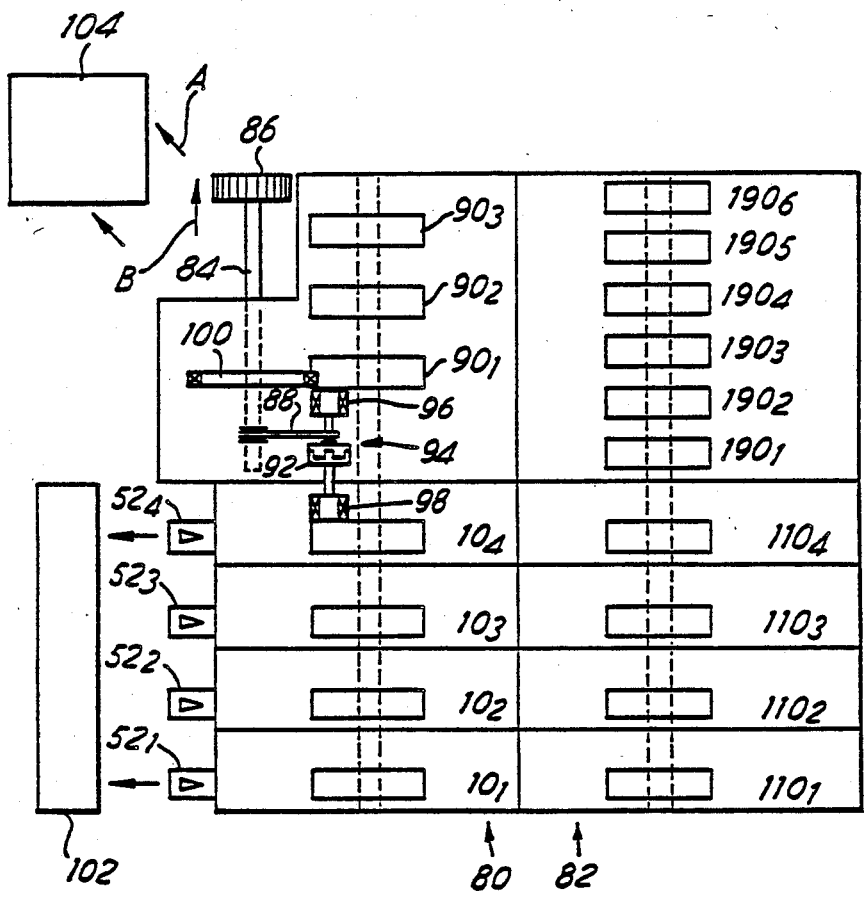
FIG. 6 is a partially-schematic plan view of a complete counter including counter sections as shown in FIGS. 1 to 3.

FIG. 6 shows in partially schematic form a complete counter suitable for use in a postage meter. The counter includes a descending register 80 and an ascending register 82. The descending register 80 includes seven sections of different orders and thus allows a maximum count of 9,999,999 of units of the appropriate value. This side of the counter is set to a required credit value, and it then counts down by the appropriate value of each franking operation until some predetermined relatively low value is reached, whereupon the postage meter is locked by a locking mechanism and will not function until further credit has been added and the locking mechanism reset. The ascending register 82 counts upwards from zero or some other predetermined figure (set at manufacture) and does not include any resetting feature. Thus it is always possible to see the total franked value over the life of the postage meter, irrespective of regular credit resetting of the descending register 80. A consequence of this is that more sections are required on the ascending register, and ten are shown in FIG. 6, which will count up to 9,999,999,999. Different numbers of sections in the ascending and/or descending registers can be provided as required.

The operation of the counter sections will be broadly similar in each of the registers 80,82 but with the following detail differences.

Since the sections have to decrement on the descending register and increment on the ascending register, a similar arrangement with numbers provided in a reverse configuration on each number drum will achieve this effect. FIG. 6 shows four descending register sections $\mathbf{10_1}$ to $\mathbf{10_4}$ each similar to the section 10 shown in FIGS. 1 to 3. Ascending register sections $\mathbf{110_1}$ to $\mathbf{110_4}$ can be provided as generally similar versions to the section 10 shown in FIG. 2, although the respective Geneva shaft and mechanism can be provided on the opposite side, i.e. the right-hand side as shown in FIG. 6. If the counter is to operate with a rising tooth accounting mechanism, it is possible to arrange for the accounting gears 44 of both ascending and descending register sections of each order to be activated by a single rising tooth mechanism. The ascending register sections $\mathbf{110_1}$ to $\mathbf{110_4}$ are not resettable and therefore the reset thumbwheel and intermediate gear arrangements are omitted on that side.

Since the accounting mechanism of the postage meter only operates on the lower order sections (four lowest order sections as shown), the higher order sections of the counter do not need ratchet mechanisms in their number drums since, on the ascending side, only carry transfer operations will need to be effected; there will be no direct count input from the accounting mechanism during franking. On the descending register 80, a conventional reset mechanism is provided acting on a higher order section $\mathbf{90_1}$. This includes a reset shaft 84 with a resetting knob 86 fixed to the shaft 84, both of which are rotatable and slideable outwardly. When resetting of the higher order sections is required, a locked and/or sealed cover 104 is removed and this provides access to the knob 86. When the knob 86 is pulled back as shown, an actuating member 88 attached so as not to rotate with the shaft 84 disengages a dog clutch 92 provided on a Geneva mechanism 94 connecting the section $\mathbf{90_1}$ and the next lower order section $\mathbf{10_4}$. The Geneva mechanism 94 includes a Geneva pinion 96 and a Geneva lock element 98 separated by the dog clutch 92. In normal operation, the dog clutch 92 is engaged and the Geneva mechanism 94 operates exactly as described previously to transfer carry movement between the sections. When the resetting knob 86 is pulled back as shown and the dog clutch 92 disengaged, a gear 100 fixed to the reset shaft 84 also moves back to engage a gear (not shown) on the number wheel assembly. Thus connection to the lower order sections $\mathbf{10_1}$ to $\mathbf{10_4}$ is broken and rotation of the knob 86 will cause rotation of the number wheel assembly of the section $\mathbf{90_1}$. The sections $\mathbf{90_2}$ and $\mathbf{90_3}$ are reset by receiving carry transfer inputs via their Geneva gears from the section $\mathbf{90_1}$, only the section $\mathbf{90_1}$ being directly resettable by rotation of the knob 86.

Higher order sections $\mathbf{190_1}$ to $\mathbf{190_6}$ of the ascending register 82 are similar to sections $\mathbf{90_1}$ to $\mathbf{90_3}$ of the descending register 80, except that no resetting arrangement is required or provided.

The four lower order sections $\mathbf{10_1}$ to $\mathbf{10_4}$ can be reset, after removal of a locked and/or sealed cover 102, by rotating individual thumbwheels $\mathbf{52_1}$ to $\mathbf{52_4}$ for each section $\mathbf{10_1}$ to $\mathbf{10_4}$. Thus resetting of the lower order number drums can be achieved conveniently and rapidly.

It will be apparent that detail variations could be made to the arrangement outlined above and such alterations of a minor nature are considered to be within the scope of the invention.

We claim:

1. A counter mechanism including a descending register receiving a direct count input from an accounting mechanism of a postage meter, comprising: a plurality of number wheels (14) representing different number orders of accounted value and having transfer mechanisms (22,24) for providing a carry movement to a next higher order, and a resetting wheel for each of the higher order number wheels, each resetting wheel (52) including a ratchet mechanism for allowing resetting of the respective number wheel (14) in only one direction, wherein the accounting mechanism only operates on the lower order number wheels.

2. A counter mechanism according to claim 1, wherein each resetting wheel comprises a thumbwheel (52) and a coaxial gear (54), the ratchet mechanism acting between the thumbwheel (52) and the coaxial gear (54), rotation of the coaxial gear (54) causing rotation of the respective number wheel (14).

3. A counter mechanism according to claim 2, wherein the coaxial gear (54) is connected to the number wheel (14) through an intermediate gear (56).

4. A counter mechanism according to claim 3, wherein the ratchet mechanism comprises a first part having a generally cylindrical internallyprofiled surface with a plurality of ratchet steps (70) corresponding to stop positions of the ratchet mechanism, the steps (70) being separated by low gradient portions (76), a second part of the ratchet mechanism comprising a rotatable central member (72) with at least one resilient projection (74) projecting in a direction substantially tangential to the internally-profiled surface of the first part, the resilient projection (74) being biased radially outwardly so as to engage one of the ratchet steps (70) and to prevent rotation in one direction while allowing rotation in the other direction by resiliently yielding over the low gradient portions (76) of the internally-profiled surface.

5. A counter mechanism according to claim 4, wherein two resilient projections (74) are provided on opposite sides of the rotatable central member (72).

6. A counter mechanism according to claim 4, wherein the resilient projections (74) are angled, relative to a tangential direction, slightly less than the low gradient portions (76) of the internally-profiled surface of the first part, thereby providing a positive return action to the corresponding ratchet step (70).

7. A counter mechanism including a descending register receiving a direct count input from an accounting mechanism of a postage meter, comprising: a plurality of number wheels (14) representing different number orders of accounted value and having transfer mechanisms (22,24) for providing a carry movement to a next higher order, each number wheel (14) including a ratchet mechanism, a first part (16) of the ratchet mechanism having a generally cylindrical internally-profiled surface having a plurality of ratchet steps (70) corresponding to stop positions of the ratchet mechanism, the steps (70) being separated by low gradient portions (76), a second part (18) of the ratchet mechanism comprising a rotatable central member (72) with at least one resilient projection (74) projecting in a direction substantially tangential to the internally-profiled surface of the first part, the resilient projection (74) being biased radially outwardly so as to engage one of the ratchet steps (70) and to prevent rotation in one direction while allowing rotation in the other direction by resiliently yielding over the low gradient portions (76) of the internally-profiled surface, the resilient projections (74) being angled slightly less, relative to a tangential direction, than the low gradient portions (76) of the internally-profiled surface of the first part (16), thereby providing a positive return action to the corresponding ratchet step (7), and a resetting wheel associated with each of the higher order number wheels for resetting the respective number wheel in only one direction each resetting wheel including a ratchet mechanism for allowing resetting of the respective number wheel in only one direction.

* * * * *